US009004054B2

(12) United States Patent
Khoshnood

(10) Patent No.: US 9,004,054 B2
(45) Date of Patent: Apr. 14, 2015

(54) AUTO ARROW REST

(71) Applicant: Bahram Khoshnood, Cumming, GA (US)

(72) Inventor: Bahram Khoshnood, Cumming, GA (US)

( * ) Notice: Subject to any disclaimer, the term of this patent is extended or adjusted under 35 U.S.C. 154(b) by 62 days.

(21) Appl. No.: 13/724,593

(22) Filed: Dec. 21, 2012

(65) Prior Publication Data

US 2014/0174420 A1 Jun. 26, 2014

(51) Int. Cl.
*F41B 5/22* (2006.01)
*F41B 5/14* (2006.01)

(52) U.S. Cl.
CPC ..... *F41B 5/143* (2013.01)

(58) Field of Classification Search
CPC ..... F41B 5/143
USPC ..... 124/44.5
See application file for complete search history.

(56) References Cited

U.S. PATENT DOCUMENTS

| | | | | |
|---|---|---|---|---|
| 4,287,868 | A * | 9/1981 | Schiff | 124/44.5 |
| 4,907,566 | A * | 3/1990 | Klein | 124/44.5 |
| 5,150,700 | A * | 9/1992 | Troncoso | 124/44.5 |
| 6,595,195 | B1 * | 7/2003 | Barner et al. | 124/44.5 |
| 7,963,279 | B2 * | 6/2011 | Harwath et al. | 124/44.5 |

* cited by examiner

*Primary Examiner* — John Ricci
(74) *Attorney, Agent, or Firm* — Brient Globerman, LLC

(57) ABSTRACT

An arrow rest for supporting an arrow on an archery bow. In various embodiments, the arrow rest includes an over-center spring that is operatively coupled to a body of the arrow rest and a rotatable cam received in the arrow rest body. The rotatable cam is rotationally fixed to an arrow launcher. The over-center spring biases the arrow launcher into a first loading position when the spring is in a first position on one side of a central axis about which the cam rotates, and into a second launching position when the spring moves to an opposite side of the cam central axis. A release mechanism is configured to move the arrow launcher from the second, launching position to the first, loading position when an arrow is fired from the bow, but will not move the arrow launcher to the first, loading position if the bow is let down.

19 Claims, 7 Drawing Sheets

AUTO ARROW REST

BACKGROUND

Arrow rests are used in combination with a bow to support an arrow during draw of the bow's bowstring. Because of an arrow's fletching, arrow rests can interfere with the flight of an arrow as the arrow passes the arrow rest by coming into contact with the fletching of the arrow. Accordingly, there is a need for improved arrow rests that address this issue.

SUMMARY

An arrow rest for supporting an arrow that is in a launching position on a bow, according to particular embodiments, comprises an arrow launcher and an arrow launcher movement mechanism. In various embodiments, the arrow launcher is adapted to be moved between: (1) a first position in which the arrow launcher is in a loading position; and (2) a second position in which the arrow launcher is in a launching position. In particular embodiments, the arrow launcher movement mechanism is configured to: (1) move from a first position where the arrow launcher is in the second launching position to a second position where the arrow launcher is in the first loading position in response to a user firing the bow, and (2) not move between the first position to the second position in response to a user letting down the bow without firing the arrow.

An arrow rest for supporting an arrow that is in a launching position on a bow, according to various embodiments comprises a body, a generally cylindrical cam that is configured to rotate with respect to the body, a launcher rotatably mounted adjacent the cam so that rotation of the cam causes the launcher to rotate, a locking mechanism operatively coupled to the cam; and a release mechanism operatively coupled to the cam, the release mechanism configured to release the locking mechanism. In particular embodiments, the locking mechanism is configured to move between: (a) a first position that maintains the launcher in a first, loading position prior to the arrow being loaded in the arrow rest, and (b) a second position that maintains the launcher in a second, launching position so that the launcher supports a shaft of the arrow when the arrow is in the launching position. In particular embodiments, the locking mechanism maintains the launcher in the second position if the arrow is released from the launching position without firing the arrow from the bow. In various embodiments, the release mechanism is configured to move the locking mechanism from the second position to the first position in response to the arrow being fired.

An arrow rest for supporting an arrow that is in a launching position on a bow, according to various embodiments, comprises a cam that is configured to rotate about a central axis; a launcher rotatably mounted adjacent the cam so that rotation of the cam causes the launcher to rotate; a first spring having a first end and a second end, wherein the spring second end is operatively coupled to the cam; and a second spring having a first end operatively coupled to the cam and a second end configured to be coupled to the bow. In particular embodiments, the first spring biases the cam into: (1) a first position where the launcher is in a first, loading position; and (2) a second position where the launcher supports the arrow when the arrow is in the launching position. In various embodiments, the second spring is configured to move the cam from the second position to the first position when the arrow is fired from the bow.

BRIEF DESCRIPTION OF THE DRAWINGS

Having described various embodiments in general terms, reference will now be made to the accompanying drawings, which are not necessarily drawn to scale, and wherein.

DETAILED DESCRIPTION OF VARIOUS EMBODIMENTS

Various embodiments will now be described more fully hereinafter with reference to the accompanying drawings, in which various relevant embodiments are shown. The invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
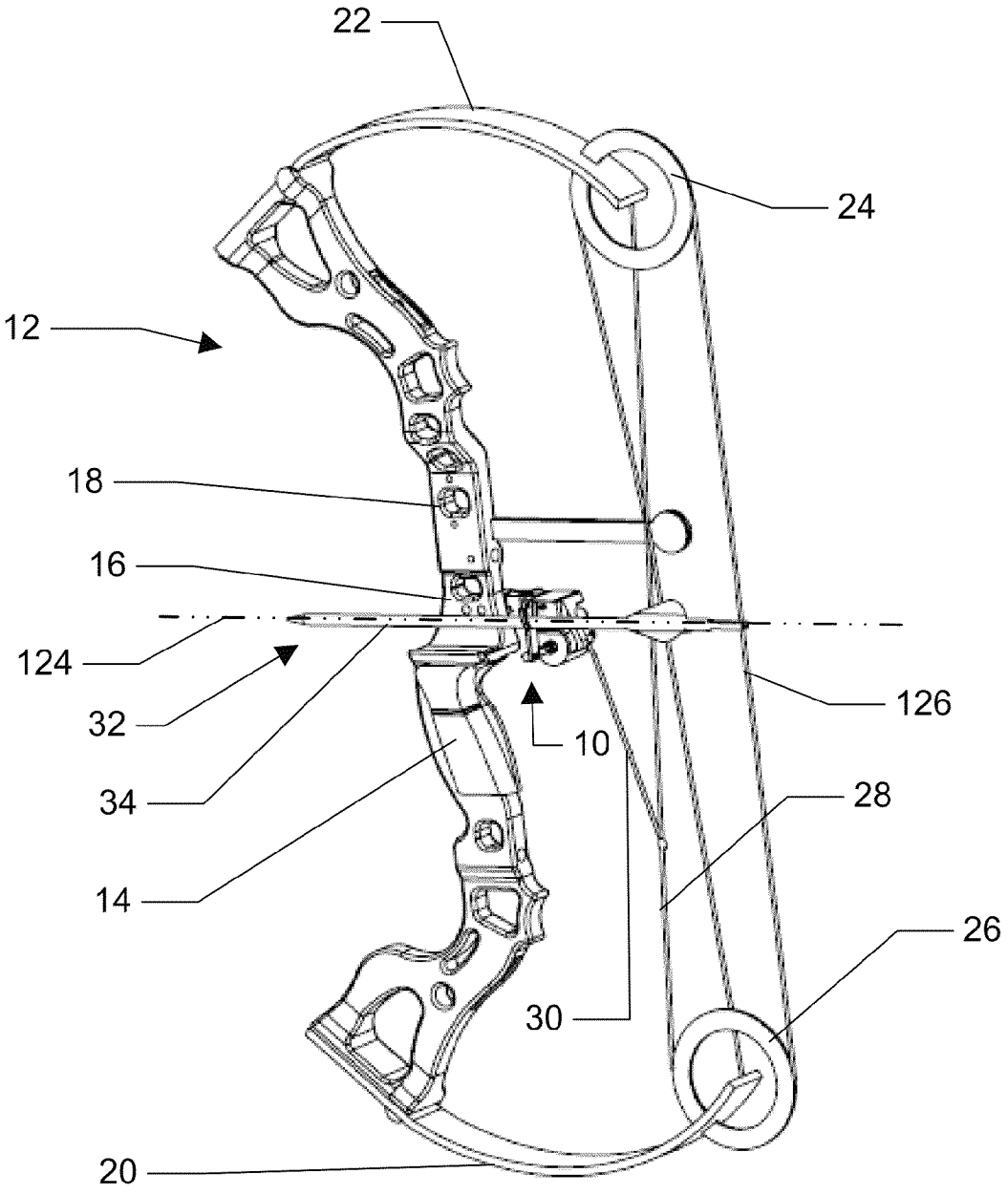
FIG. 1 is a perspective view of a first embodiment of an arrow rest on a bow.

An arrow rest 10 according to a particular embodiment is shown in FIGS. 1-6. Referring in particular to FIG. 1, the arrow rest 10 is shown attached to a bow 12. The bow 12 has a grip 14, an arrow shelf 16, a sight window 18, a lower limb 20, an upper limb 22, an idler wheel 24, a cam 26 and a bow string 28. The arrow rest 10 is coupled to the bow 12 proximate the arrow shelf 16 and is operatively coupled to the bow string 28 via a string 30. An arrow 32, when loaded on the bow 12, has an arrow shaft 34 that is received and supported by the arrow rest 10.

Figure 2:
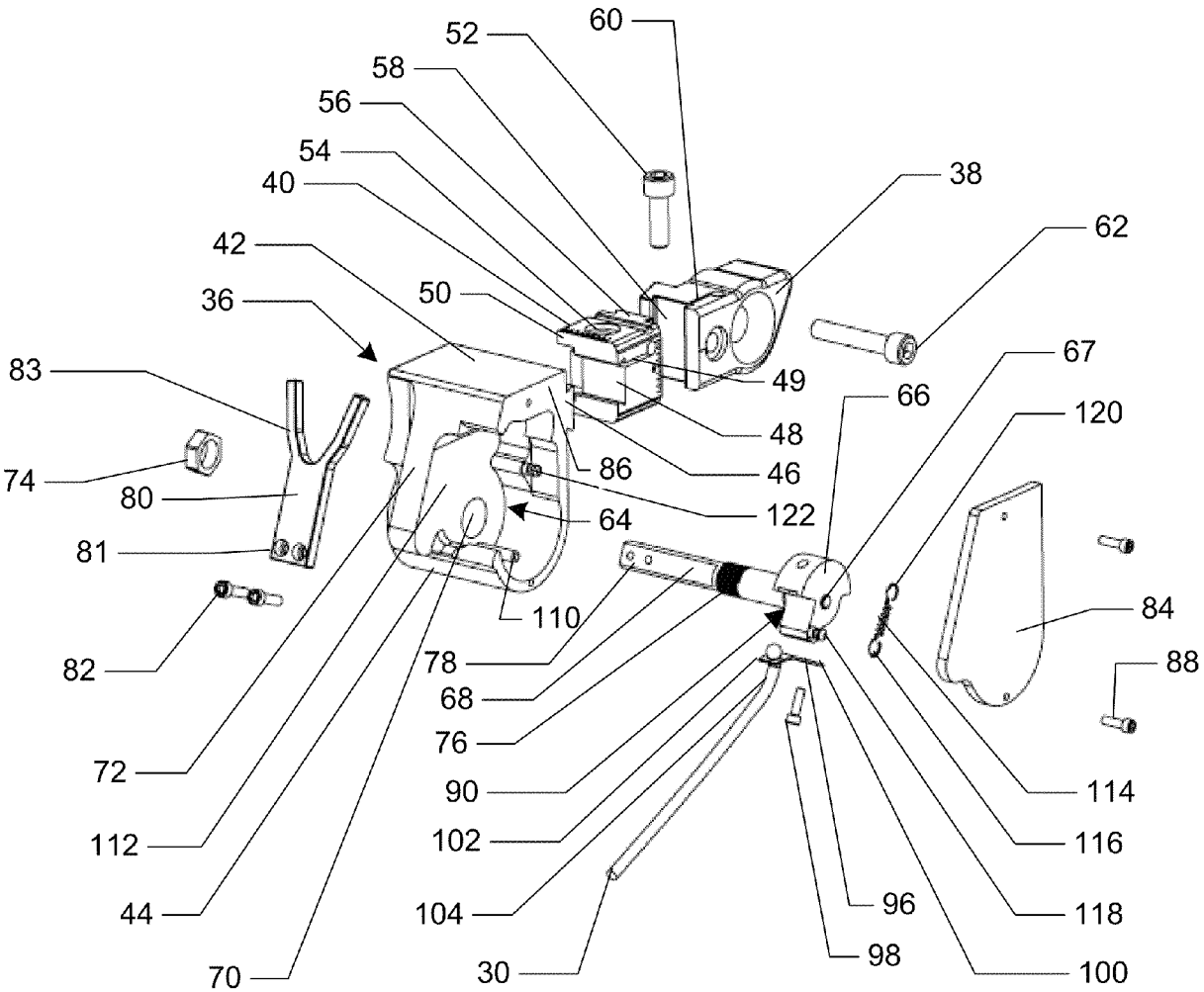
FIG. 2 is an exploded perspective view of the arrow rest of FIG. 1.

Referring to FIG. 2, the arrow rest 10 comprises: (1) a body 36; (2) a mounting bracket 38; and a coupling assembly 40. The arrow rest body 36 is coupled to the mounting bracket 38 by the coupling assembly 40. These elements together form the arrow rest 10 and will be described in greater detail below.

Arrow Rest Structure

Still referring to FIG. 2, the arrow rest body 36 comprises a first portion 42 and a generally circular second portion 44. The first portion 42 defines a key 46 that is received in a correspondingly shaped keyway 48 formed in the coupling assembly 40 A slot 49 is formed through the coupling assembly 40 and defines an adjustable keyway portion 50. A threaded screw 52 is received in the coupling assembly through a bore 54. In this configuration, the size of the keyway 48 can be adjusted to allow the body's key 46 to slide in the keyway 48 when the screw 52 is loosened, and to maintain the body 36 in a fixed position with respect to the coupling assembly 40 when the screw 52 is tightened. In this way, the body key 46 is slidably received in keyway 48 to allow the user to adjust the horizontal position of the arrow rest with respect to the bow to adjust for windage.

The adjustment assembly 40 is also operatively coupled to the mounting bracket 38 by a key 56 formed on the adjustment assembly and a corresponding keyway 58 formed in the mounting bracket 38. In this way, the key 56 is slidably received in the keyway 58. Similar to the connection between the body 36 and the coupling assembly 40, a slot 60 is formed through the keyway 58 so that the width of the keyway can be adjusted by loosening and tightening a screw 62, which causes the slot to open and close. Said another way, by loosening screw 62, the width of keyway 58 widens thereby allowing the key 56 to slide through the keyway 58. As a result, the elevation of the arrow rest with respect to the bow 12 can be adjusted by the user. Once an elevation is selected, the screw 62 is tightened thereby creating a press-fit between the keyway walls and the key.

The arrow rest body 36 defines a cavity, generally denoted at 64, that is configured to receive a generally cylindrical (e.g., cylindrical) cam 66. It should be understood that the cam 66 may be formed in any suitable shape based on the dimensions and operation of the arrow rest. The cam 66 is coupled to a support member 68 so that the support member rotates with the cam 66. In various embodiments, the cam 66 and support member 68 may be integrally formed. In other embodiments, the cam 66 may be coupled to the support member 68 by a fastener. In other embodiments, the cam 66 may be operatively coupled to the support member 68 by another suitable structure (e.g. gears) so that when the cam rotates the support member rotates.

The cam 66 is positioned in the body second portion 44 so that the support member 68 passes through a through-hole 70 formed in a wall 72 of the body 36. The cam 66 is rotatably retained in the body second portion 44 by a nut 74 that is threadably received on a threaded portion 76 of the support member. In this way, the cam 66 is axially fixed in the body 36, but can rotate with respect to the body 36 about a central axis 67.

A distal end 78 of the support member 68 is coupled to an arrow launcher 80 that has a first end 81 and a second V-shaped end 83. The arrow launcher's first end 81 is coupled to the support member 68 by suitable fasteners 82 (e.g., screws, bolts, rivets, weldments, etc.). The arrow launcher 80 has a first end 81. In this configuration, the arrow launcher is rotationally fixed to the cam 66 through the support member 68. As a result, when the cam 66 rotates about its central axis 67, the launcher will rotate as well. In some embodiments, the support member 68 rotates about the cam's central axis 67. Thus, in these embodiments, the arrow launcher 80 also rotates about the cam's central axis 67. A cover 84 attaches to a wall 86 of the body 36 to close off the body cavity 50. Cover 84 can be secured to wall 86 by fasteners 88 (e.g., screws, rivets or any other suitable fastener).

Figure 3:
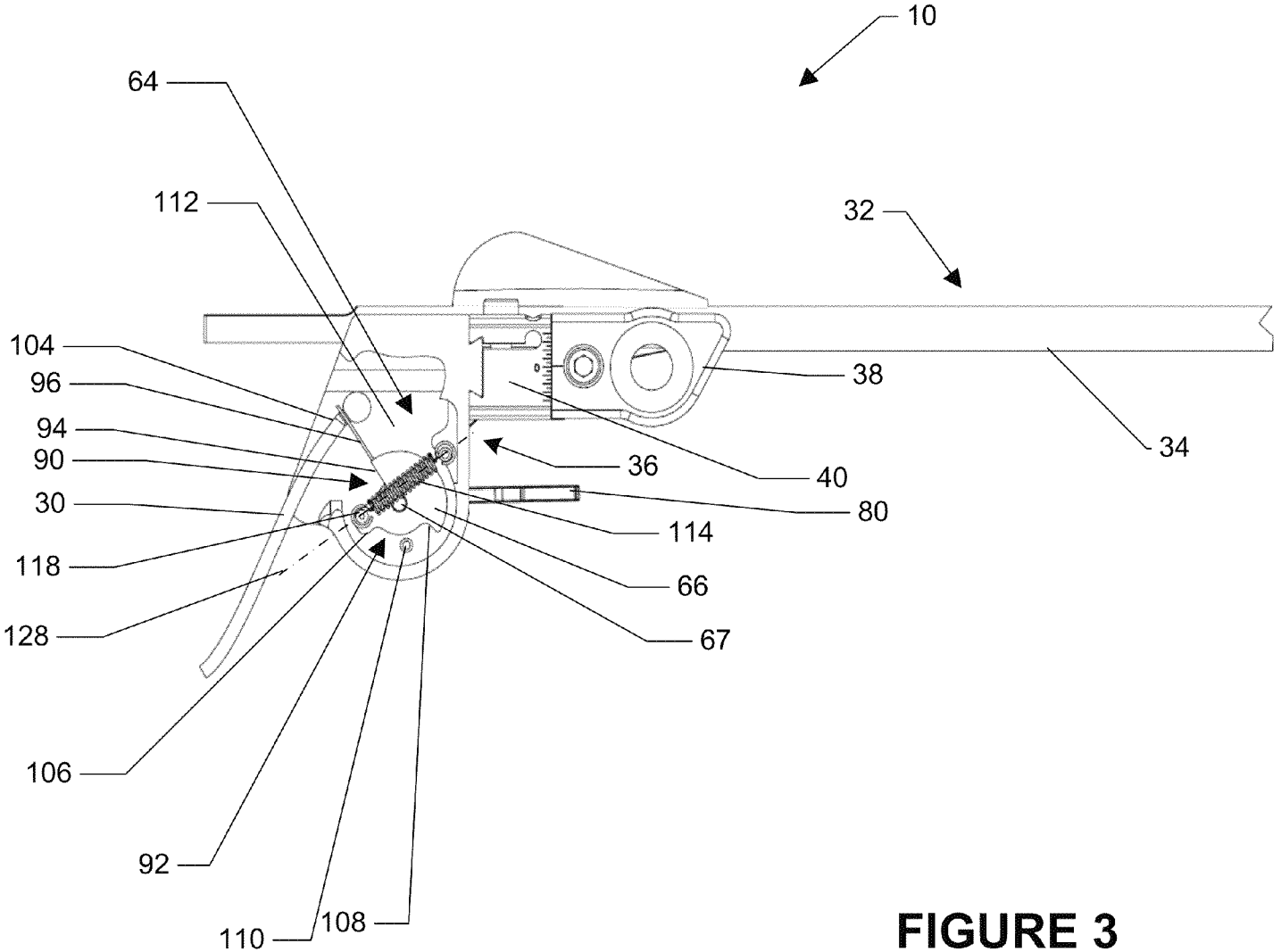
FIG. 3 is a side view of the arrow rest of FIG. 1 in a first loading position.

Referring to FIG. 3, the cam 66 defines a first recessed portion 90 and a second recessed portion 92. The first recessed portion 90 is defined by a wall 94 on which a leaf spring 96 is attached by a fastener 98 (FIG. 2), such as a screw, rivet or any other means of fastening the leaf spring to the wall. In particular, a first end 100 of the leaf spring 96 is coupled to the wall 94 (FIG. 3), and a second end 102 of the leaf spring 96 is operatively coupled to a first end 104 of the string 30. The second recessed portion 92 defines a first wall 106 and a second wall 108. The recessed first and second walls 106 and 108 function as stops that interact with a pin 110 formed on an inner body surface 112 to prevent the cam 66 from over rotating in either the clockwise or counterclockwise direction, as explained in greater detail below. For purposes of this disclosure, all references to direction and position are made from the vantage point of the viewer in FIG. 3.

Referring again to FIG. 2, an over-center extension spring 114 has a first looped end 116 that is coupled to the cam 66 by a pin 118 formed on the cam, and a second looped end 120 that is coupled to a pin 122 formed on the body inner surface 112. The cam 66, the spring 114 together form an over-center locking mechanism whose operation will be explained in further detail below. An over-center spring should be recognized by those skilled in the art as referring to a spring that is attached to a pivoting structure (cam 66), and is positioned to rotate or translate across a pivot point or center point (cam central axis 67) as the pivoting structure rotates. An over center spring provides a biasing force upon the pivoting structure in one direction while on a first side of the center point, the biasing force dropping to zero as the spring rotates or translates to the center point, after which the spring provides a biasing force on the pivoting member in the opposite direction on a second side of the center point.

The arrow rest 10 may be attached to the bow 12 (FIG. 1) in any suitable manner using mounting bracket 38 (e.g., using suitable fasteners such as screws, bolts or clips). When attached to the bow 12, the arrow rest 10 is adapted to selectively maintain an arrow 32 in a launching position relative to the bow 12. That is, referring once again to FIG. 1, when the arrow rest 10 is mounted to the bow 12, proximate to the arrow shelf 16, an axis 124 of the arrow is substantially perpendicular (e.g., perpendicular) to a portion 126 of the string 28.

Exemplary Use

Referring again to FIG. 3, the arrow rest 10 is shown in a starting position (the first position) where the launcher 80 (FIG. 2) is down. When in the first position, extension spring 114 is in an initial position where an axis 128 of the spring 114 is positioned above the cam central axis 67. While in the first position, the extension spring 78 is under slight tension thereby biasing the cam 66 in the clockwise direction. Furthermore, the recess wall 108 prevents the cam 66 from over rotating in the clockwise direction. As illustrated in FIG. 3, the user can load the arrow 32 onto the bow without the launcher 80 (FIG. 2) interfering. In particular, the user places the arrow 32 adjacent the arrow shelf 16 (FIG. 1) and nocks the arrow on the string 126 (FIG. 1). When the arrow 32 is initially loaded, the arrow shaft 34 may rest on the arrow shelf 16 adjacent the arrow launcher 80. Thus, when the user draws the bow 12 the arrow launcher 80 rotates into the launching position thereby supporting the arrow shaft 34. Alternatively, the user may rotate the launcher into the launching position manually or by pulling the string 30.

Figure 4:
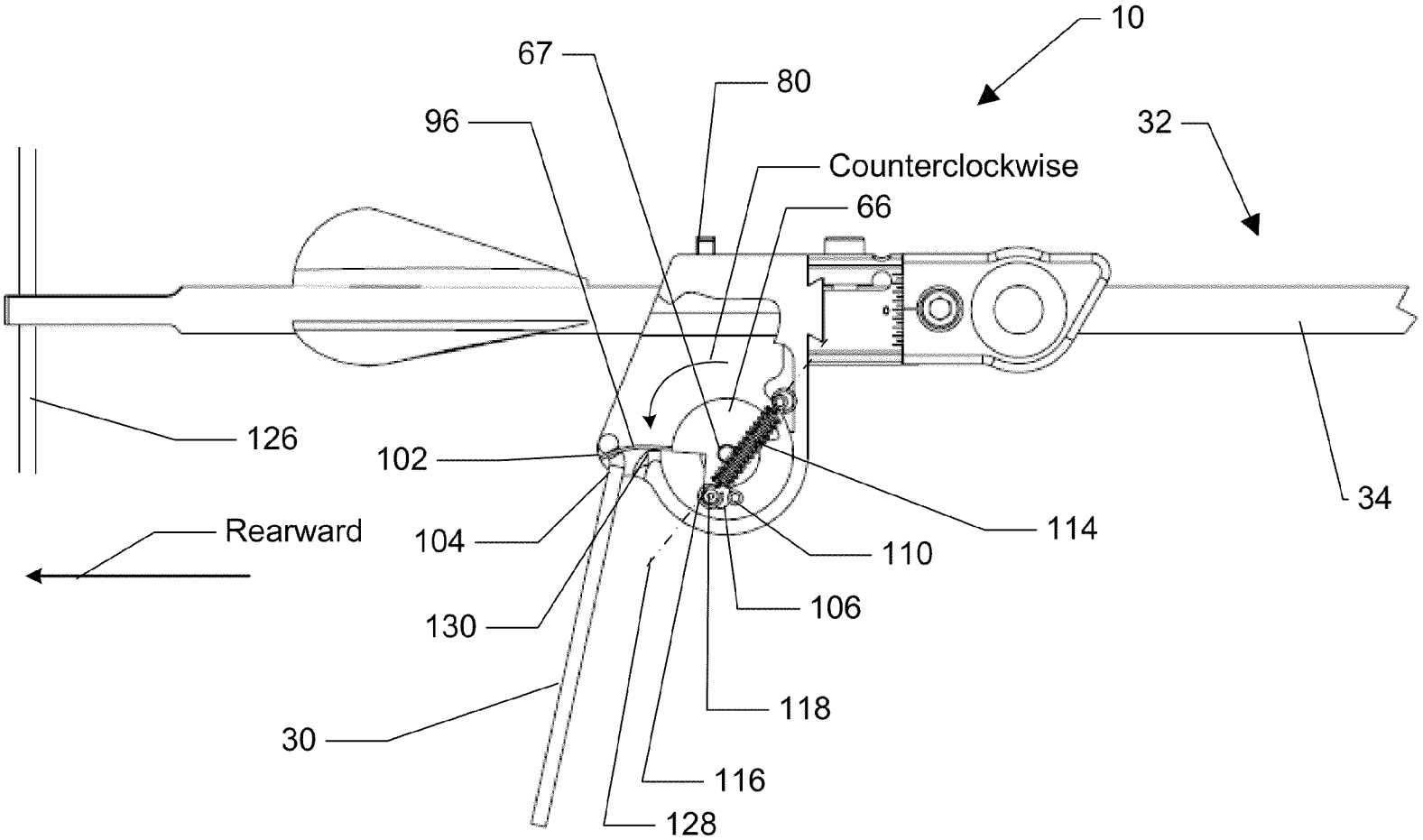
FIG. 4 is a side view of the arrow rest of FIG. 1 in a second launching position.
Figure 5:
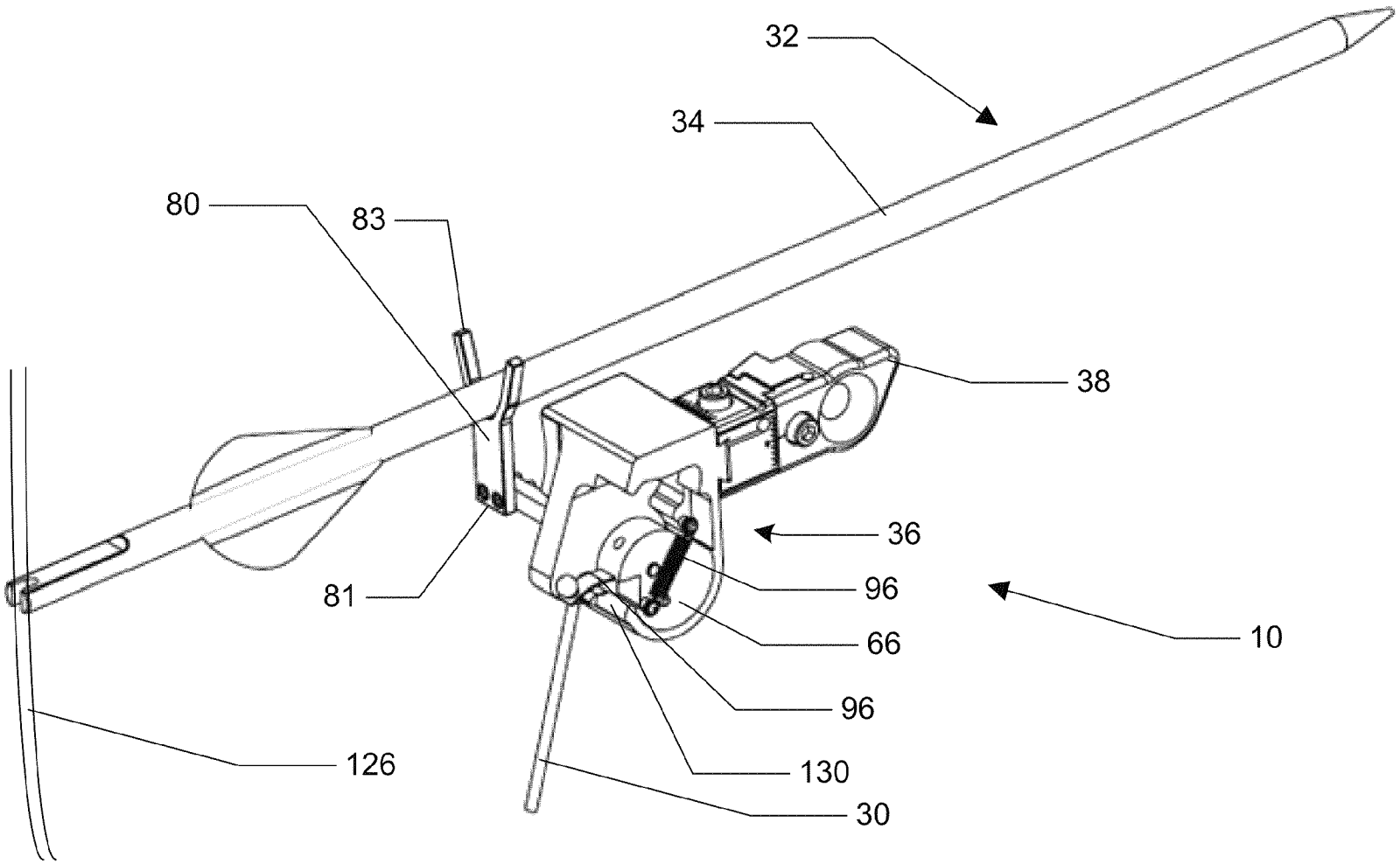
FIG. 5 is a perspective view of the arrow rest of FIG. 1.

Referring to FIGS. 4 and 5, once the user nocks the arrow and draws the bow by pulling the string portion 126 (FIG. 1) reward, the bow string 28 is pulled downward toward cam 26 thereby pulling arrow rest string 30 downwardly away from the arrow rest body 36. Since the string end 104 is coupled to the leaf spring 96, as string 30 moves downward it causes cam 66 and pin 118 to rotate counterclockwise thereby moving the spring first end 116 away from the spring second end 120 causing the spring axis 128 to move to the opposite side of the cam central axis 67. Thus, as the cam 66 rotates in the counterclockwise direction, potential energy begins to build up in the spring 114 as the spring first end 116 is pulled apart from the spring second end 120. Once the spring axis 128 moves past the cam central axis 67, the potential energy in the spring 114 biases the cam in the counterclockwise direction until the recess first wall 106 abuts against the body pin 110. In this position (the second position), the arrow launcher 80 is moved to a raised position to support the arrow shaft 34 when the arrow is in a launching position.

As discussed above and still referring to FIG. 4, cam 66 can only rotate a certain counterclockwise distance as the bow string 126 is drawn to move the arrow into the launching position since the recess' first wall 106 prevents the cam from further rotating as the wall abuts against the body pin 110. As a result, if the bow string 126 (FIG. 1) is further drawn rearward, the string 30 continues to exert a downward force on the leaf spring second end 102 causing the leaf spring 96 to pivot around an edge 130 of the body 36. Said another way, in particular embodiments, as the leaf spring 96 abuts the body edge 130, the body edge acts as a pivot point, and the leaf spring's second end 102 rotates counterclockwise about the body edge 130. As a result, potential energy is stored in the leaf spring as long as the bow is drawn and the arrow remains in the launching position.

Figure 6:
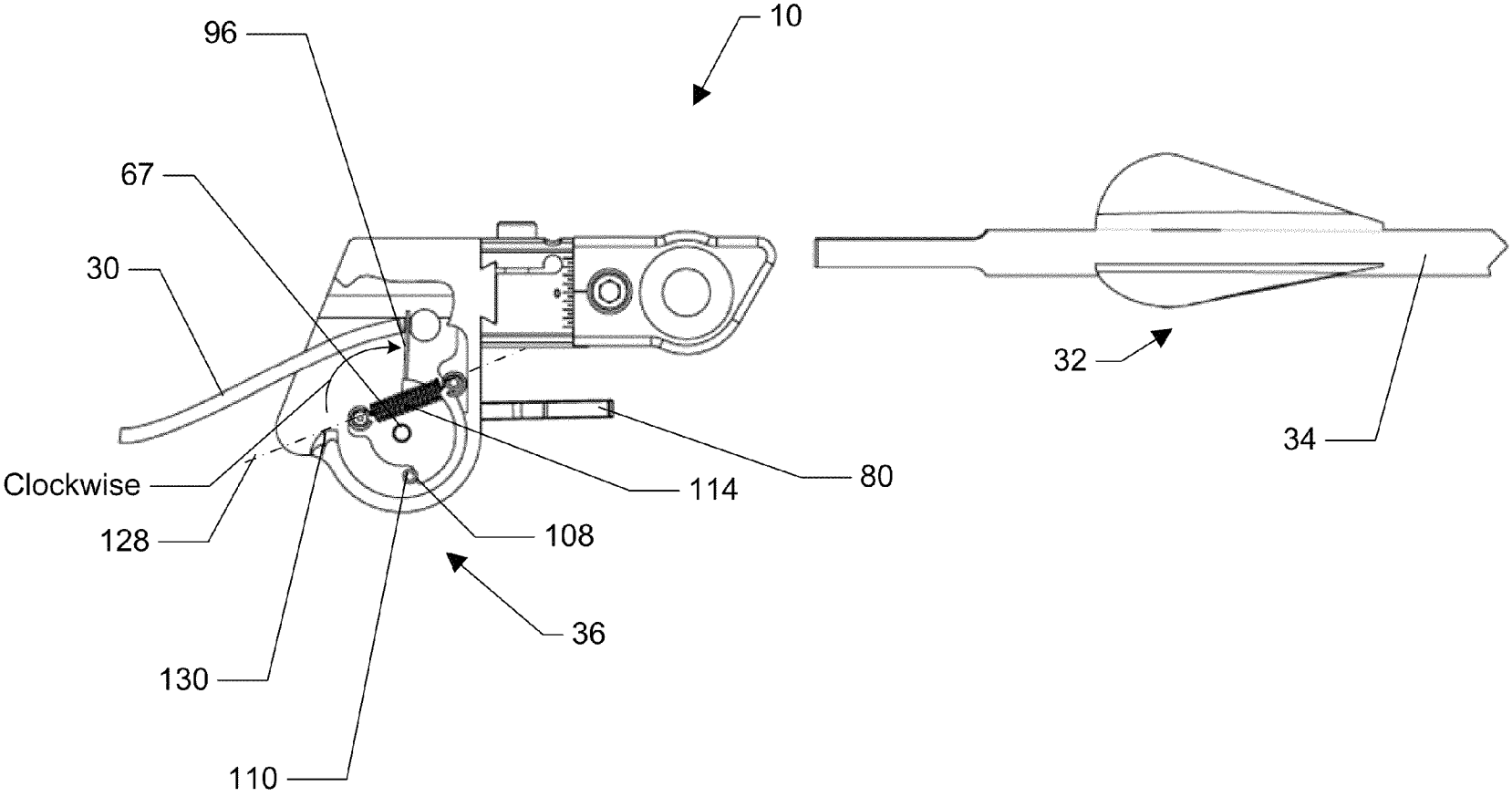
FIG. 6 is a side view of the arrow rest of FIG. 1 after an arrow has been fired from the bow.

Referring to FIG. 6, the arrow rest 10 is shown substantially immediately (e.g., immediately) after the user fires the arrow 32. Once the user fires the arrow 32 by releasing the bow string 126 (FIG. 1), the downward tension on string 30 is immediately released allowing the leaf spring second end 102 to snap upwardly from the stored potential energy and rotate clockwise about body edge 130. As the leaf spring second end 102 snaps upward, the leaf spring exerts a sufficient amount of torque on cam 66 to overcome the counterclockwise bias that spring 114 exerts on cam 66. Accordingly, as cam 66 rotates clockwise against the force of spring 114, the spring's second end moves with pin 118 thereby causing the spring's axis 128 to once again move up and over the cam central axis 67. Once the spring's axis 128 moves over the cam's central axis 67, the spring 114 once again biases cam 66 in the clockwise direction so that the launcher 80 moves back into its first loading position since the cam 66 is linked to the arrow launcher 80 through the support member 68. Thus, the arrow rest of the present system is adapted to move the arrow launcher 80 far enough toward the first, loading position substantially immediately (e.g., immediately) after the arrow 32 is fired so the arrow launcher 80 does not interfere with the flight of the arrow 32 as the bow 12 launches the arrow 32.

From the above disclosure, one of skill in the art should understand that the spring 114 and the cam 66 function as an over-center locking mechanism that, when in a first position, biases the arrow launcher 80 into a first loading position, and when in a second position, biases the arrow launcher 80 into a second, launching position. Moreover, it should be clear that, in various embodiments, if the user lets down the bow (i.e., releases the potential energy on the bow string 126 without firing the arrow), the locking mechanism will maintain the arrow launcher 80 in the second, launching position since the release mechanism (leaf spring 96) does not snap back causing the over-center spring to move over-center to bias the cam in the clockwise direction. As such, various embodiments of the present structure result in an arrow rest having an arrow launcher that moves from a first loading position into a second launching position as the bow is drawn. Furthermore, in various embodiments, the present structure's locking mechanism retains the arrow launcher in the second launching position until the arrow is fired from the bow.

ALTERNATIVE EMBODIMENTS

First Alternative Embodiment

Figure 7:
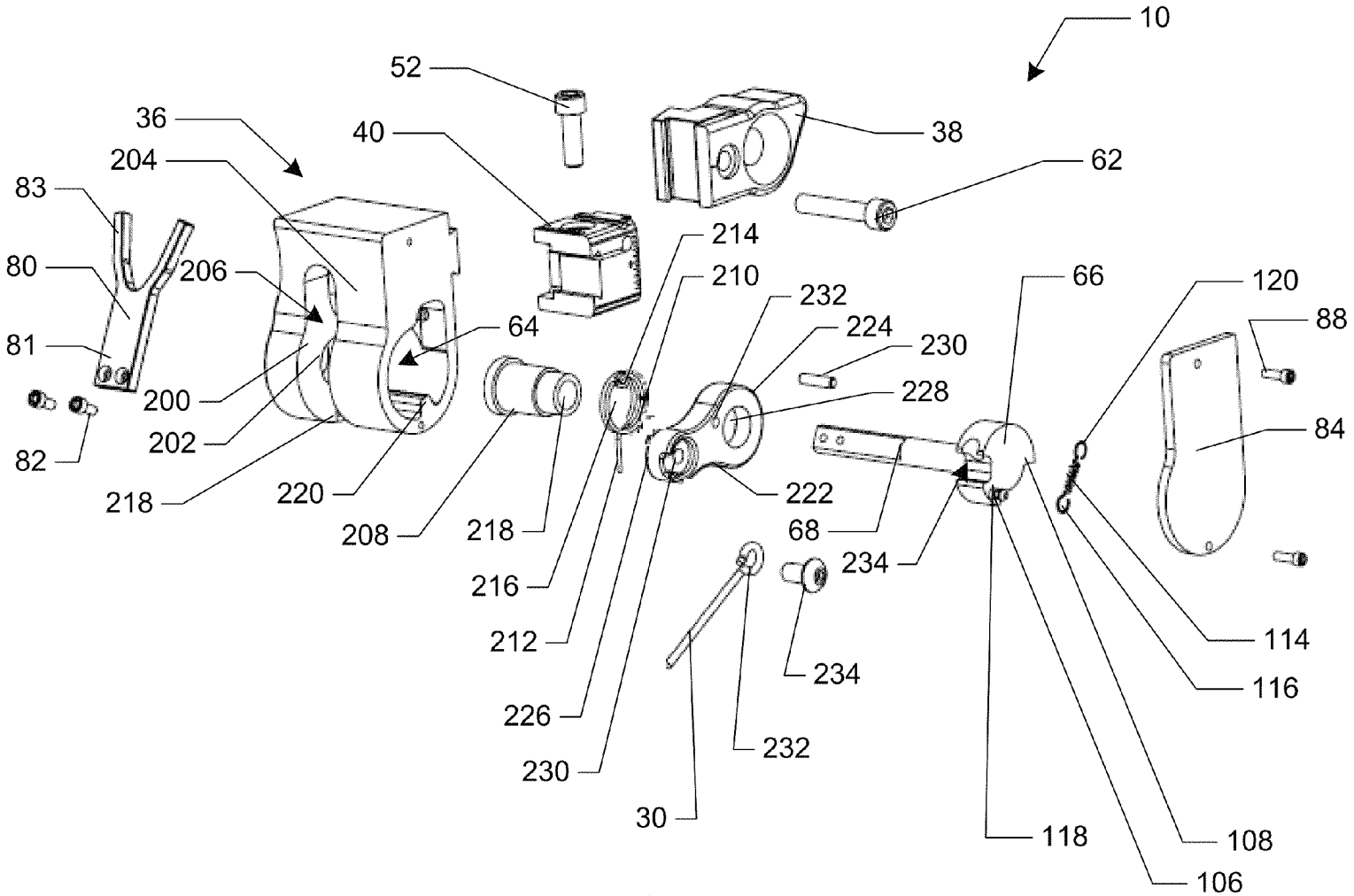
FIG. 7 is an exploded view of a second embodiment of an arrow rest.

Referring to FIG. 7, a second embodiment of an arrow rest 10 is illustrated. For purposes of clarity and ease of understanding, only the differences between this embodiment and the embodiment illustrated in FIGS. 1-6 will be discussed. Arrow rest 10 has a body 36, an adjustment assembly 40 and a mounting bracket 38. The body has a back wall 200 with a hole 202 formed therethrough, a sidewall 204 having a slot 206 formed therethrough, and a cavity 64 defined by the back and the side walls. A bearing sleeve 208 is received through the back wall's hole 202. A coil spring 210 has a first end 212, a second end 214 and an opening 216 formed therethrough. The coil spring is received on the bearing sleeve 208 so that the coil spring's first end 212 is received in a vertical elongated blind bore 218 formed in the body's back wall 200.

A cam 66 having a support member 68 that is rotationally fixed thereto is rotatably received in the body's cavity 64. The cam 66 has a recess formed therein, where the recess has a first wall 106 and a second wall 108. When the cam 66 is inserted into the body's cavity 64 so that the support member 68 passes through a hole 218 in the bearing sleeve. A projection 220 that extends radially inward from the body's sidewall 204 is received intermediate the recess' first and second walls 106 and 108.

An arm 222 has a first end 224 and a second end 226. A first through-hole 228 is formed in the arm's first end 224, and a second through-hole 230 is formed in the arm's second end 226. During assembly of the arrow rest, the arm's first end 224 is placed through the body's slot 206 so that the arm's first hole 228 receives the bearing sleeve 208. In this position, the coil spring 210 is positioned intermediate the body's back wall 200 and the arm's first end 224. Additionally, when the arm's first end is properly positioned, the coil spring's second end 214 is received in a blind bore (not shown) formed proximate the arm's first end. A pin 230 is received in a blind bore 232 formed in the arm 222. The pin 230 is operatively received in a second recess 234 formed in the cam 66. Because the recess 234 is wider than the diameter of the pin 230, the arm can rotate over a limited distance without engaging the cam.

A first end 232 of the string 30 is coupled to the arm's second end 226 by a fastener 234 that is received in the second bore 230 formed in the arm's second end 226. In this way, when the string 30 is pulled downward by the bow string 126, the arm 222 rotates about the bearing sleeve 208 causing the pin 230 to engage the cam 66. As the arm is further rotated counterclockwise, the cam 66 is also rotated counterclockwise causing the arrow launcher to move from the first loading position into the second launching position. At the same time, the spring 114 moves from above the cam center to below the cam center. As a result, the spring 114 biases the cam in the counterclockwise direction to maintain the arrow launcher in the launching position. Furthermore, coil spring 210 winds tighter thereby storing potential energy in the spring.

The operation of the first alternative embodiment is essentially the same as that of the embodiment illustrated in FIGS. 1-6 and described above. That is, an over-center spring 114 coupled between the cam 66 and the body functions to maintain the arrow launcher 80 in one of two positions—a loading position and an arrow launching position. Thus, if the user draws down the bow without firing the arrow, the arrow launcher will remain in the second launching position since the over-center spring 114 continues to bias the cam 66 in the counterclockwise direction. If, however, the user fires the arrow 32 from the bow 12, the coil spring 210 will unwind causing the arm 222 to rotate in the clockwise direction. Because the arm 222 is operatively coupled to the cam 66 by the pin 230, the momentum of the arm rotating in the clockwise direction will cause the cam to rotate a sufficient amount to move the over-center spring 114 to the other side of the cam center so that the spring 114 biases the cam in the clockwise direction. As a result, the arrow launcher 80 will move from the launching position into the loading position as the arrow is fired. It should be clear from the above disclosure that the coil spring 210 and arm 222 function as a release mechanism similar to the leaf spring in the embodiment illustrated in FIGS. 1-6.

Second Alternative Embodiment

In a second alternative embodiment, other types of locking mechanisms may be used in place of the over-center spring 114. For example, the cam 66 may having a spring winding that biases the cam in the clockwise direction. When the user draws the bow string 126, the cam may turn counterclockwise against the bias of the spring winding until a spring loaded ball in the cam 66 engages with a detent formed in the body. In this way, the spring loaded ball and detent will maintain the cam and arrow launcher in the second launching position until the leaf spring 96 snaps upward to overcome the force exerted by the spring loaded ball in the detent. As soon as the upward force exerted by the leaf spring overcomes the frictional force between the spring loaded ball and detent, the spring winding would cause the cam to rotate in the clockwise direction thereby moving the launcher back into the first loading position.

CONCLUSION

Many modifications and other embodiments of the invention will come to mind to one skilled in the art to which this invention pertains having the benefit of the teachings presented in the foregoing descriptions and the associated drawings. For example, as will be understood by one skilled in the relevant field in light of this disclosure, the invention may take form in a variety of different mechanical and operational configurations. For example, in the embodiments described herein, the body is closed by a cover. In various other embodiments, the body may be open. Additionally, in other embodiments, the arrow launcher may move to the loading position when the bow is drawn down (i.e., the bow is released, but the arrow is not fired). Therefore, it is to be understood that the invention is not to be limited to the specific embodiments disclosed and that the modifications and other embodiments are intended to be included within the scope of the appended exemplary concepts. Although specific terms are employed herein, they are used in a generic and descriptive sense only and not for the purposes of limitation. The description of the above alternative should teach one of skill in the art that many more alternatives exist that can maintain the arrow launcher in the second launching position even if the bow is undrawn.

I claim:

1. An arrow rest for supporting an arrow that is in a launching position on a bow, said arrow rest comprising:
- a. a cam that is configured to rotate about a central axis;
- b. a launcher rotatably mounted adjacent said cam so that rotation of said cam causes said launcher to rotate;
- c. a first spring having a first end and a second end, wherein said spring second end is operatively coupled to said cam, and wherein said first spring biases said cam into:
  - (1) a first position where said launcher is in a first, loading position, and
  - (2) a second position where said launcher supports said arrow when said arrow is in said launching position, and
- d. a second spring having a first end operatively coupled to said cam and a second end configured to be coupled to said bow, wherein said second spring is configured to move said cam from said second position to said first position when said arrow is fired from said bow.

2. The arrow rest of claim 1, wherein said second spring is a leaf spring.

3. The arrow rest of claim 1, wherein said second spring is configured to exert a rotational force on said cam that is larger than the force exerted by said first spring when said cam is in said second position.

4. The arrow rest of claim 1, wherein said launcher and said cam rotate about a common axis.

5. The arrow rest of claim 1, wherein
- a. said first spring is positioned on a first side of said cam central axis when said launcher is in said first loading position; and
- b. said first spring is positioned on a second side of said cam central axis when said launcher is in said second launching position.

6. The arrow rest of claim 1, wherein said arrow rest is configured to maintain said launcher in said second, launching position when said bow is let down without firing said arrow.

7. The arrow rest of claim 6, wherein said arrow rest is further configured to allow said arrow launcher to move from said second position to said first position when said arrow is fired from said bow and second spring force exerted on said cam exceeds said first spring force exerted on said cam.

8. An arrow rest for supporting an arrow that is in a launching position on a bow, said arrow rest comprising:
- a. a body;
- b. a generally cylindrical cam that is configured to rotate with respect to said body;
- c. a launcher rotatably mounted adjacent said cam so that rotation of said cam causes said launcher to rotate;
- d. a locking mechanism operatively coupled to said cam; and
- e. a release mechanism operatively coupled to said cam, said release mechanism configured to release said locking mechanism, wherein
  - i. said locking mechanism is configured to move between:
    - a first position that maintains said launcher in a first, loading position prior to said arrow being loaded in said arrow rest, and
    - a second position that maintains said launcher in a second, launching position so that said launcher supports a shaft of said arrow when said arrow is in said launching position,
  - ii. said locking mechanism maintains said launcher in said second position if said arrow is released from said launching position without firing said arrow from said bow, and
  - iii. said release mechanism is configured to move said locking mechanism from said second position to said first position in response to said arrow being fired.

9. The arrow rest of claim 8, wherein said locking mechanism further comprises an over-center mechanism.

10. The arrow rest of claim 9, said over-center mechanism further comprising a spring having:
- a. a first end;
- b. a second end; and
- c. an axis that extends between said first end and said second end.

11. The arrow rest of claim 10, wherein
- a. said cam rotates about a central axis;
- b. said spring biases said cam in a first direction about said cam central axis when said locking mechanism is in said first position, and
- c. said spring biases said cam in a second direction about said cam central axis when said locking mechanism is in said second position.

12. The arrow rest of claim 11, wherein a. said cam central axis is substantially perpendicular to said spring axis, b. when said locking mechanism is in said first position, said spring axis is positioned on a first side of said cam central axis; and c. when said locking mechanism is in said second position, said spring moves to an opposite side of said cam central axis.

13. The arrow rest of claim 8, said release mechanism comprising a second spring having a first end operatively coupled to said cam.

14. The arrow rest of claim 13, wherein said second spring is a leaf spring.

15. The arrow rest of claim 13, said second spring comprising a first end operatively coupled to said cam and a second end configured to be coupled to said bow, wherein said second spring is configured bias said cam from said second position to said first position when said arrow is fired from said bow.

16. The arrow rest of claim 8, said cam further comprising a first recessed area defining a first wall and a second wall, and a pin that extends through said recess, wherein:

a. when said locking mechanism is in said first position, said recess first wall is adjacent said pin, and b. when said locking mechanism is in said second position, said recess second wall is adjacent said pin.

17. An arrow rest for supporting an arrow that is in a launching position on a bow, said arrow rest comprising:

a. an arrow launcher adapted to be moved between:

i. a first position in which said arrow launcher is in a loading position; and ii. a second position in which said arrow launcher is in a launching position;

b. an arrow launcher movement mechanism that is configured to:

i. rotate about a central axis between a first position where said arrow launcher is in said second launching position into a second position where said arrow launcher is in said first loading position in response to a user firing said bow, and ii. not rotate between said first position to said second position in response to a user letting down said bow without firing said arrow, c. a cam that rotates about said central axis;

d. a first spring having i. a first end operatively coupled to said cam;

ii. second end; and iii. an axis that extends between said first and said second ends of said spring; and e. a second spring having:

i. a first end operatively coupled to said cam; and ii. a second end configured to be coupled to said bow, wherein rotation of said cam causes said arrow launcher to rotate.

18. The arrow rest of claim 17, wherein said first spring biases said cam into said cam first position when said first spring is positioned on a first side of said central axis, and said first spring biases said cam into said cam second position when said first spring is positioned on a second side of said central axis.

19. The arrow rest of claim 17, wherein said second spring moves said cam from said cam second position to said cam first position when said arrow is fired from said bow.

* * * * *